US005213426A

United States Patent [19]

Ewing

[11] Patent Number: 5,213,426

[45] Date of Patent: May 25, 1993

[54] AUTOMATIC PRINTING MEDIA FEED APPARATUS

[75] Inventor: Kenneth R. Ewing, Fremont, Calif.

[73] Assignee: Apple Computer, Inc., Cupertino, Calif.

[21] Appl. No.: 905,762

[22] Filed: Jun. 29, 1992

[51] Int. Cl.[5] ..... B41J 13/10

[52] U.S. Cl. ..... 400/624; 271/126; 271/114

[58] Field of Search ..... 400/624, 625, 628, 629; 271/109, 110, 114, 115, 116, 117, 118, 119, 126

[56] References Cited

U.S. PATENT DOCUMENTS

| | | | |
|---|---|---|---|
| 3,908,982 | 9/1975 | Abe | 271/114 X |
| 4,822,019 | 4/1989 | Nagira | 400/624 X |
| 4,925,062 | 5/1990 | Tsukamoto et al. | 271/115 |
| 4,925,177 | 5/1990 | Nakamura et al. | 271/110 |
| 4,971,310 | 11/1990 | Motegi et al. | 271/126 |

FOREIGN PATENT DOCUMENTS

| | | | |
|---|---|---|---|
| 0189945 | 11/1982 | Japan | 271/127 |
| 0188463 | 10/1984 | Japan | 400/624 |
| 0190132 | 10/1984 | Japan | 271/109 |
| 0031985 | 2/1985 | Japan | 400/625 |
| 0277520 | 12/1986 | Japan | 271/126 |

*Primary Examiner*—Edgar S. Burr
*Assistant Examiner*—Christopher A. Bennett
*Attorney, Agent, or Firm*—Blakely, Sokoloff, Taylor, Zafman

[57] ABSTRACT

The present invention comprises an apparatus for feeding print media, such as paper, into a printer. The paper is stored in a stack in a movable paper tray. The tray is lifted so that the top sheet of paper is brought in contact with the feed roller. The feed roller feeds the top sheet into position for printing. The tray is then backed away from the sheet which is being fed thereby minimizing the resistance on the page being fed. A unitary motor controls both the motion of the feed rollers and the movement of the paper tray. A spring serves to bias the paper tray toward the feed rollers. Thus the present invention serves to eliminate the necessity for two separate motors and prevents the feeding of the paper until after the paper tray is properly positioned.

3 Claims, 6 Drawing Sheets

FIG. 2
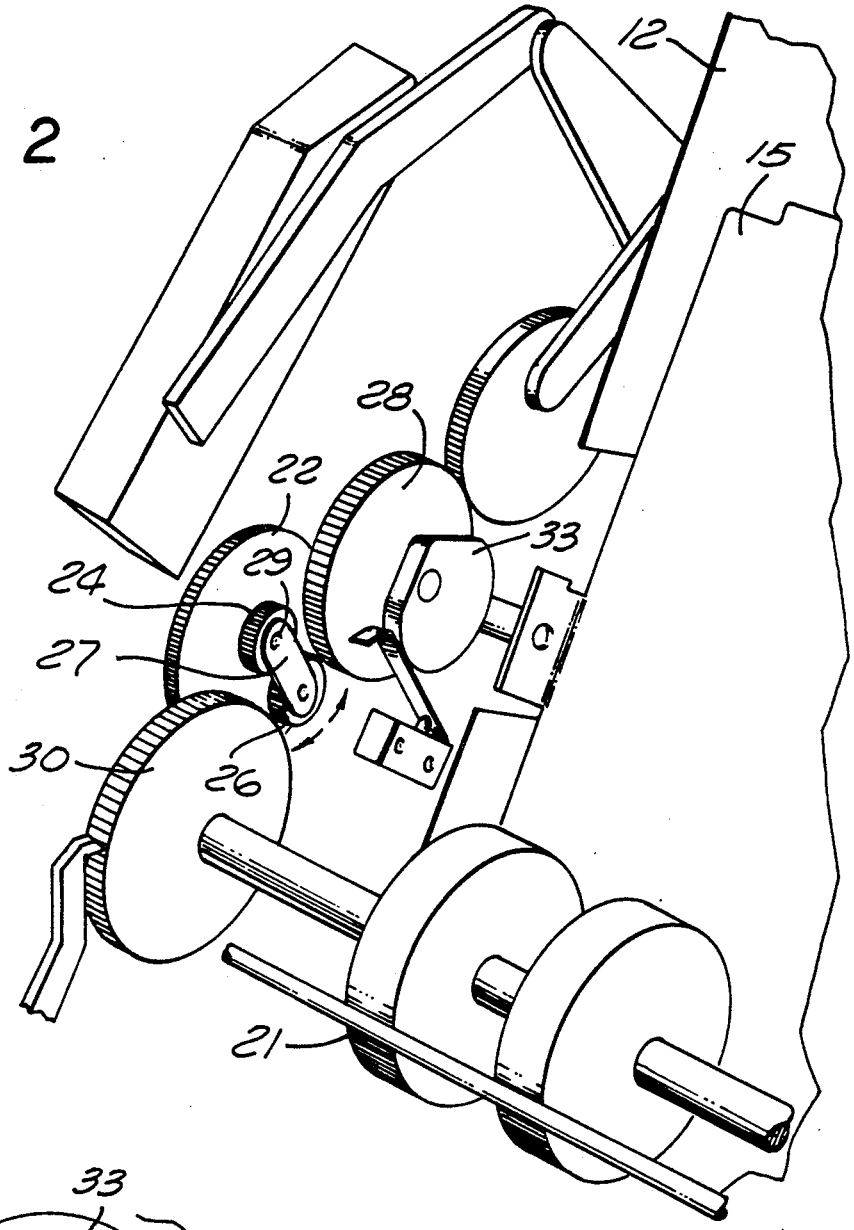
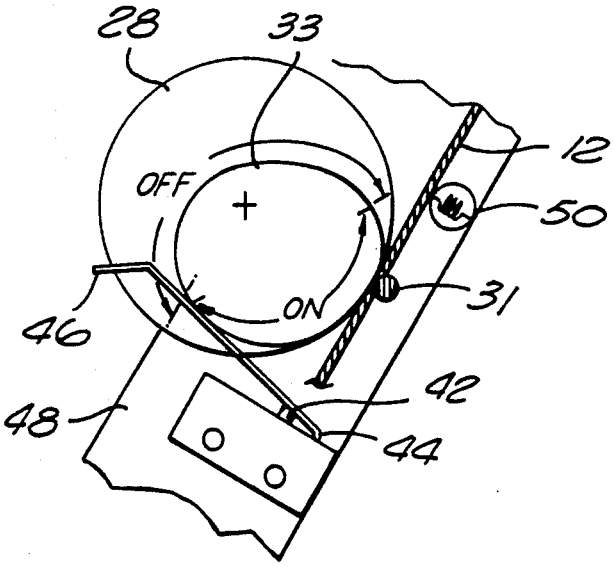
FIG. 3

AUTOMATIC PRINTING MEDIA FEED APPARATUS

BACKGROUND OF THE INVENTION

1. Field of the Invention

This invention relates to an automatic paper loading mechanism and method for printers, and more particularly to an improved automatic paper loading mechanism and method in which the paper supply tray is moved to a first position to load the paper into the machine and then backs away from the first position to a second position to reduce the drag on the paper once loaded, the entire movement of the paper and tray being driven by a single motor and a plurality of gears.

2. Art Background

When paper is automatically fed from a stack in a printer, as opposed to a manual feed system, the paper is typically pressed against the remainder of the stack and dragged across the stack causing undue friction. This friction may result in misalignment of the paper in the printer, which in turn results in a skewed page of print or poor vertical registration. This is particularly problematic where the printer is a high resolution type which requires exacting placement and positioning of the paper.

There are many different mechanical arrangements for the supply of paper to a printer. A common technique for feeding paper or other print media into a printer involves the use of a pinch or feed roller or rollers which are specifically dedicated to transferring the paper from a paper tray to the nip which receives the paper. From there the paper is advanced by the rollers which drive the paper to and past the printhead. A third drive is used for movement of the paper tray as required to feed subsequent pieces of paper to the nip. In sum, the printer drive assembly of the prior art requires 3 separate drives, which invariably adds to the cost of a printer and increases the risk of required repair since any of the three motors could become disabled, thereby disabling the entire system.

More recently, Hewlett-Packard in its U.S. Pat. No. 4,728,963, described a single motor system for driving both the paper and the paper tray, which system relies upon a fairly large and complex mechanical arrangement including a mechanically actuated multiplexer for initiating the conveying of a sheet of paper from the paper supply tray to the print zone. The multiplexer includes a plurality of multiplexer gears, each being actuated by a trigger mechanism which positions the gears as necessary to drive the various systems of the printer. Because of the complex gearing which takes up a substantial amount of space, such device is larger than desired.

It would be desirable to provide a printer drive system requiring only a single motor, but which has all the features and advantages of a multiple motor system. It would also be an advantage to provide a printer drive system having a paper tray retraction system operating from the same drive motor for the best results particularly in precision printing systems. It would also be desirable to provide a compact and low cost printer with good print characteristics. These and other advantages may be found in the present invention which is described in summary below.

SUMMARY OF THE INVENTION

The present invention comprises an apparatus for feeding print media, such as paper, into a printer. The paper is stored in a stack in a movable paper tray. The tray is lifted so that the top sheet of paper is brought in contact with the feed roller which is initially not rotating. The feed roller then rotates to feed the top sheet into position for printing. The tray is then backed away from the sheet which is being fed thereby minimizing the resistance on the page being fed.

A unitary motor controls the motion of the feed rollers and actuates the paper tray. A spring provides the force required to position the paper tray. Thus the present invention serves to eliminate the necessity for two separate motors.

More specifically, for paper feeding, the motor engages one set of gears to turn the feed rollers. The same motor subsequently turns in the reverse direction causing a swing arm gear to toggle, disengaging the feed roller and engaging another set of gears which turn a cam to lift and lower the paper tray. The paper tray is spring loaded and biased toward the feed rollers. When the paper tray is in the fully up position, the cam is fully retracted from the tray such that it exerts no force against the tray and the spring force pushes the tray against the feed rollers. When the cam is in the alternative position it pushes the paper tray downward and the paper away from the paper feed rollers.

The subject invention comprises a single drive motor having a drive shaft with a gear disposed thereon, and a swing arm gear engaged therewith. Adjacent the swing arm gear on one side is a paper feed gear. Adjacent the swing arm gear on the other side thereof is a paper tray gear. An eccentric cam is coupled to said paper tray gear, said cam engaging said paper tray or a flange coupled to said paper tray. When the motor and drive shaft rotate in a first direction, the swing arm gear rotates in the same direction and engages the paper feed roller gears thereby causing them to rotate to feed paper through the paper feed roller. When the motor and drive shaft rotate in the opposite direction the swing arm rotates in the opposite direction and the swing arm gear engages the paper tray gear. This causes the paper tray gear to rotate which in turn rotates the paper tray eccentric cam, which in turn moves the paper tray. The paper tray is spring biased, preferably toward the upward position toward the cam. Thus, by controlling the rotation of the drive motor when the swing arm gear engages the paper tray gear, the paper tray can be precisely positioned in an upward or downward position in accordance with the present invention.

It is one object of the present invention to provide a printer motor drive system for transporting paper and actuating the paper tray which utilizes only a single motor.

It is another object of the present invention to provide system which withdraws a paper tray from the printer feeder to reduce drag of a sheet of paper being transported through the printer.

It is another object of the present invention to provide a new system of transporting paper through a printer which is useful, effective and economical for high accuracy printers.

It is another objection of the present invention to provide a new printer design which is more compact and requires fewer parts to perform comparably with large systems.

It is yet another object of the present invention to provide a single motor which operates independently both the movement of the paper tray and the operation of the paper feed rollers.

It is another object of the present invention to permit the independent operation of two separate and independent, but related mechanical drive systems of a printer from a single motor.

It is another object of the present invention to provide a printer which has a tray operation system integrated with a paper feed system so that the paper feed is deactuated when the paper tray is actuated to prevent the paper from feeding skewed.

These and other objects are addressed by the present invention, the drawings and details of which are described below.

BRIEF DESCRIPTION OF THE DRAWINGS

FIG. 2 is an enlarged perspective view of the gears of the subject invention.

FIG. 3 is a side view of the eccentric cam of the present invention engaging a paper tray.

DETAILED DESCRIPTION OF THE INVENTION

Figure 1:
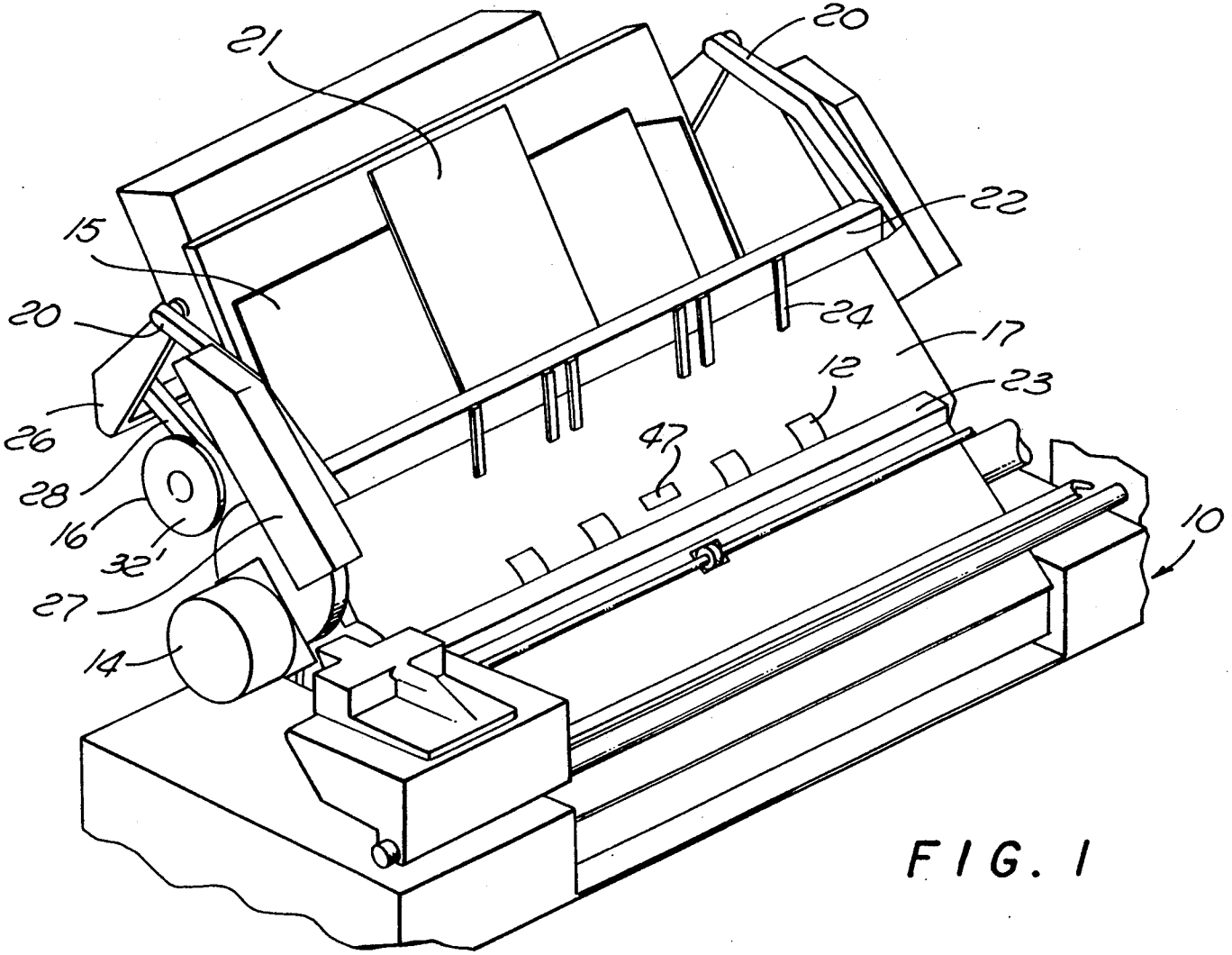
FIG. 1 is a perspective view of a printer comprising the subject invention.

The present invention as shown generally in FIG. 1 comprises a printer 10 having a paper tray 12 with paper 15 therein, a feed roller 14 and a motor drive 16. The paper or other print media is withdrawn from the paper tray, transported through the printer on a roller by pressure rollers, and is ejected out of the printer to an output paper tray. In the present invention the paper tray and output tray are both substantially vertical, although it will be appreciated by a person of ordinary skill in the art that other configurations of input and output of print media may be utilized within the scope of the present invention.

Figure 4:
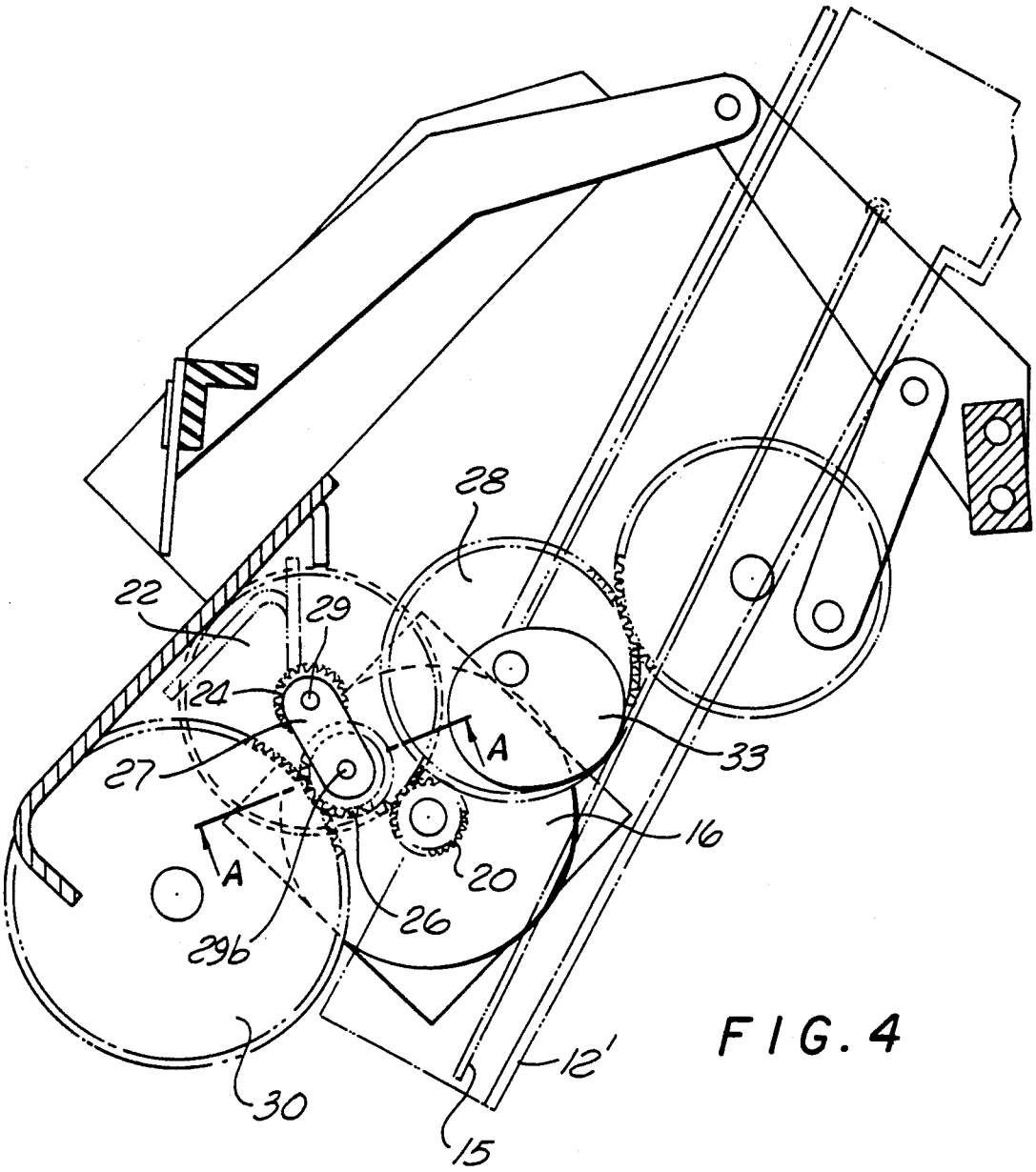
FIG. 4 is a side view of the gear system of the present invention showing the operation of the paper tray actuation portion of the system.
Figure 4A:
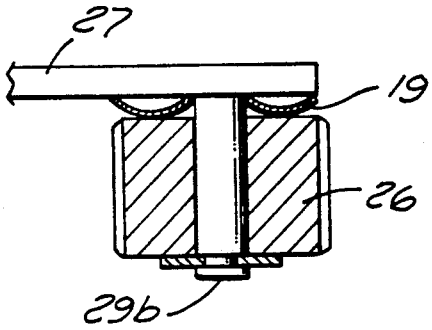
FIG. 4A is a cross-sectional view of a portion of the swing arm assembly taken through lines A—A of FIG. 4.

As shown in FIG. 2 and 4, the motor drive 16 (shown in ghost lines) is coupled to the first drive gear 20 which engages a second drive gear 22 which is concentric with, and coupled to, a third drive gear 24 which comprises a portion of the swing gear system. Specifically, the swing gear system comprises a swing gear 26 which is coupled to the third drive by a bracket 27 and which also engages and meshes with the third drive gear 24. The swing gear 26 is pivotable about the pin 29 which retains the third drive gear on the housing of the system (not shown). For proper operation, a wavy washer 19 (FIG. 4*a*) or other resistance is provided between bracket 27 and swing gear 26 to provide a slight resistance or drag necessary for the swing gear 26 to pivot between its two positions. The swing gear 26 pivots between a first position in which it engages the eccentric cam drive gear 28 and a second position in which it engages a paper feed roller gear 30. Without going into the entire description at this time, when the third drive gear 24 rotates in a clockwise direction, the swing arm gear 26 moves toward feed roller gear 30, engaging and meshing with it, and then rotating it in a counter clockwise direction. Conversely, when the third drive gear 24 rotates counterclockwise it moves the swing arm gear 26 to the eccentric cam drive gear 28, engaging and meshing with it and causing it to rotate clockwise. When the paper tray is raised, the rollers 21 engage the paper 15 frictionally and drive it through or partially through the printer 10.

As shown in FIG. 3, the paper tray 12 has a switch 48 which engages the eccentric cam 33 so that the cam turns the switch 48 on and off to indicate the position of the cam 33 as well as the position of the paper tray 12. The cam 33 also engages a paper tray at a smooth bar 31 so that the cam easily slides over the bar 31. The cam 33 is eccentric so that it pushes the bar downward or allows it to travel upwards as the cam 33 rotates. The paper tray 12 is spring actuated by spring 50 and biased toward the cam 33. The switch 48 comprises a lever 46 which pivots at point 44 and engages button 42 which generates the position signal of on or off. As illustrated, the "on" position indicates the downward position of the paper tray 12, and the "off" position indicates the upward position of the paper tray 12. The "on" and "off" positions of the cam are shown in FIG. 3.

The operation of the subject invention will now be described. The motor drive can be any type of reversible motor, many of which are known in the art. One drive which will work for the intended purpose is an Inland Nipponpulse (Japan) pulsemoter having a rating of 14 ohms per phase and 7.5 degrees per step.

Figure 5A:
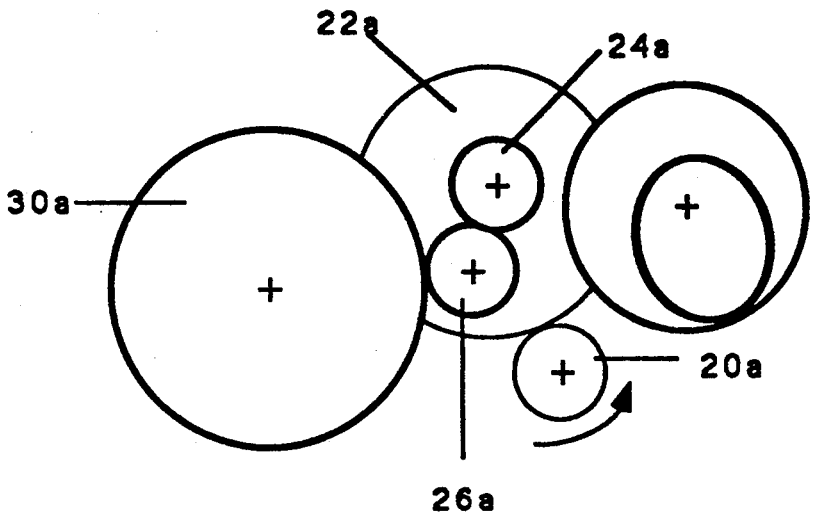
FIG. 5*a* is a gear chart of the present invention showing the rotation of the gears in accordance one operation of the present invention.

The motor 16 is coupled to a housing 13 for the printer 10, and the shaft of the motor extends through the housing and connects directly to first drive gear 18. As shown in FIG. 5*a* wherein the respective elements are designated with an 'a', when the first drive gear 18*a* is rotated clockwise it rotates second drive gear 20*a* counterclockwise. Since third drive gear 24*a* is centered with and attached to second drive gear 22*a*, they rotate together. This causes bracket 27 (not in FIG. 5*a*) and swing arm gear 26*a* to pivot towards and engage printer feed gear 30*a*, and then to rotate feed drive 30*a* causing the paper under rollers 21 (FIG. 2) to be forced into the printer.

Figure 5B:
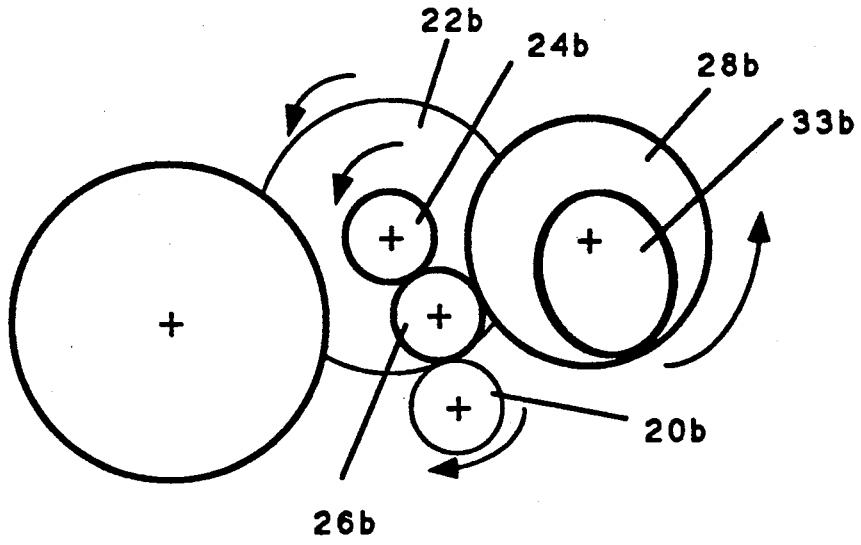
FIG. 5*b* is a gear chart of the present invention showing the rotation of the gears in accordance with another operation of the present invention.

Conversely, as shown in FIG. 5*b* wherein the elements are designated with a 'b', when the first drive gear 18*b* is rotated counterclockwise it rotates second drive gear 20*b* clockwise. Since third drive gear 24*b* is centered with and attached to second drive gear 22*b*, they rotate together. This causes bracket 27 (not shown in FIG. 5*b*) and swing arm gear 26*b* to pivot towards and engage eccentric cam gear 28*b*, and then to rotate eccentric cam gear 28*b* and cam 33*b* attached thereto, causing the paper tray 12 (FIG. 2) to travel either upward or toward the rollers 21 (FIG. 2), or away from rollers 21, to thereby engage or disengage paper 15 (FIG. 2).

Figure 6:
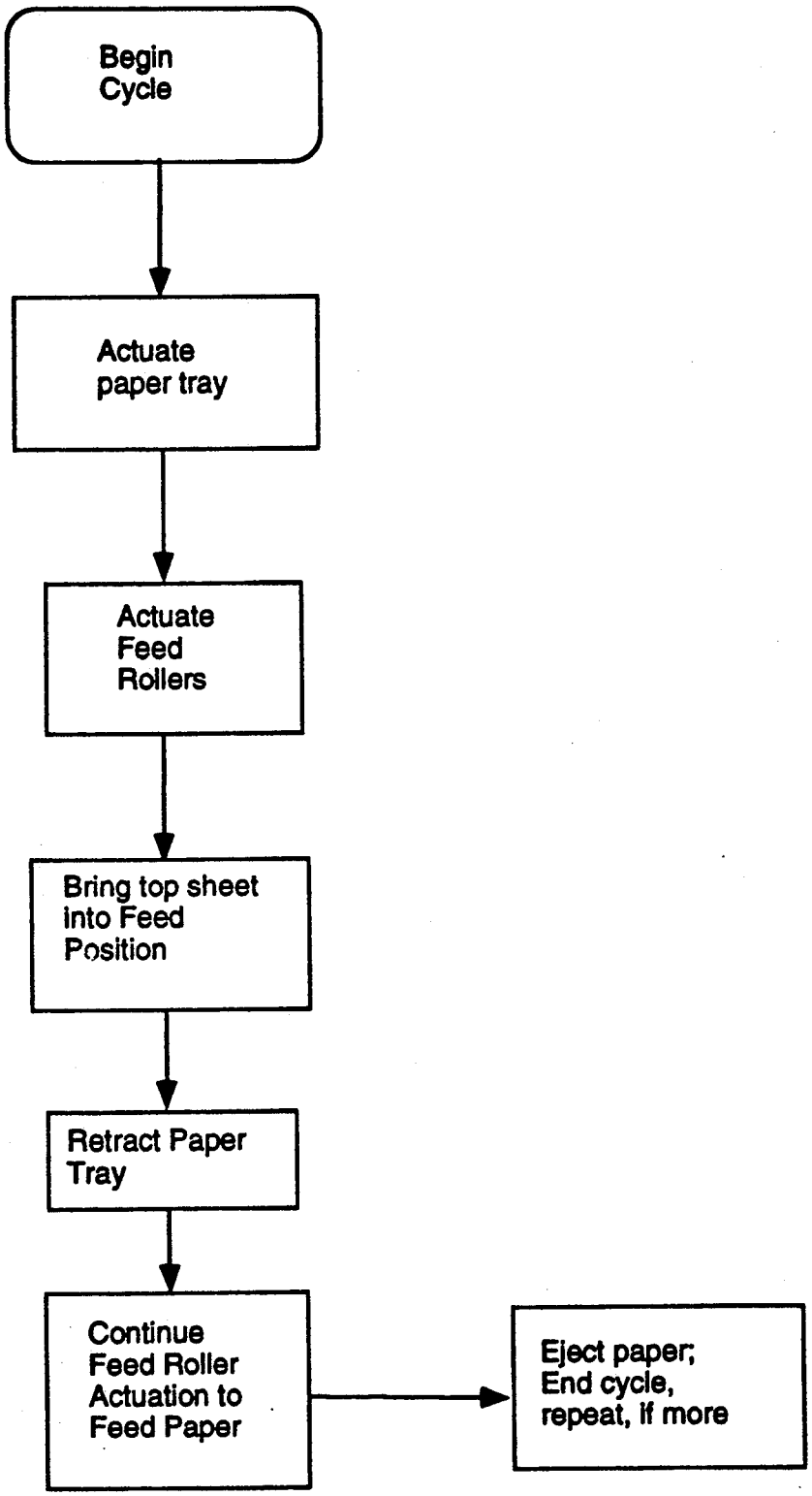
FIG. 6 is a block diagram of the steps of the present invention.
Figure 7:
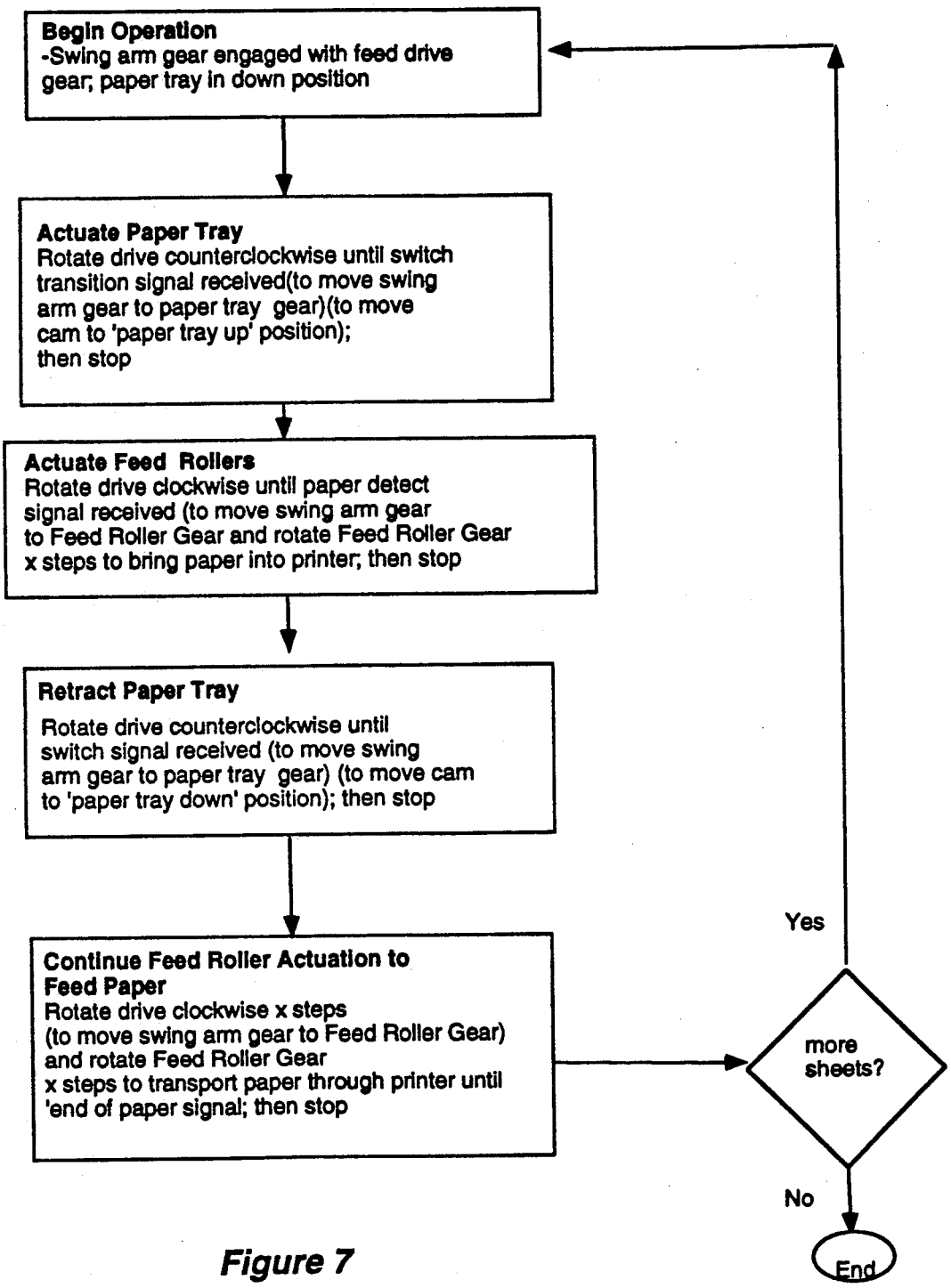
FIG. 7 is a more detailed block diagram of the steps of the present invention.

The operation of the subject invention is set forth in flow charts of FIGS. 6 and 7. FIG. 6 explains that the paper tray is first actuated to a proper position, then the feed rollers are actuated, then the top sheet of paper is fed into the printer, then the paper tray is retracted, and finally the paper is fed through a printer and ejected.

As more specifically shown in FIG. 7, initially the swing arm gear may engage the feed drive gear while the paper tray is in the retracted position. The paper tray is actuated by the drive being rotated to move the swing arm gear to the paper tray gear, and then further rotated until a transition signal is received from a switch to move the eccentric cam to the paper tray 'up' or engaged position wherein the paper is positioned against the feed rollers. The feed rollers are then actuated by rotating the drive in the opposite direction which causes the swing arm gear to disengage from the eccentric cam gear and to engage the feed roller gear. The feed roller gear is rotated a predetermined amount or until a sensor in the paper path detects the presence of the top edge of the paper, as is known in the art, in order to ensure that the printer picks up the paper being positioned by the feed rollers.

After the printer has the paper, the drive is reversed again so that the swing arm gear moves back to the eccentric cam gear and rotates it until a switch transition signal is received to retract the paper tray. Thereafter the paper is fed through the printer and the cycle can then be repeated.

It will be obvious to a person of ordinary skill in the art that many changes and modifications can be made to the above-described system which will fall within the spirit and scope of the invention as set forth in the appended claims.

What is claimed is:

1. A motor drive system for feeding paper and controlling a paper tray movement, comprising:

a single bidirectional motor drive;

a first gear coupled to said motor drive;

a transmission means;

a second gear coupled to said first gear via said transmission means;

a paper feed roller;

a paper feed gear adjacent to and engageable with said second gear, said paper feed gear being coupled to said paper feed roller;

an eccentric cam gear adjacent to and engageable with said second gear;

an eccentric cam coupled to said eccentric cam gear;

a paper tray adjacent said eccentric cam;

a biasing means for biasing said paper tray toward said eccentric cam;

whereby when said first drive gear rotates in a first direction it engages said transmission means in a first direction, causing said eccentric cam gear and said eccentric cam to rotate thereby biasing said paper tray toward a first predetermined position, and whereby when said first drive gear rotates in a second direction it engages said transmission means in a second direction causing said feed rollers to rotate.

2. The apparatus of claim 1 wherein said transmission comprises a swing arm linkage.

3. A method of feeding paper to a printer, said printer having a paper tray, paper, and a paper feed roller, comprising the steps of:

providing a unitary reversible drive motor for feeding paper to the printer and actuating the movement of the paper tray;

rotating the drive motor in a first direction causing the paper tray to move toward said paper feed roller whereby said paper contacts said paper feed rollers;

rotating said drive motor in a second direction whereby said paper feed roller is rotated a predetermined amount so that said paper in fed into said printer;

rotating said drive motor in said first direction causing said paper tray to retract from said paper feed roller and thereby minimizing friction on said paper fed into said printer; and feeding said paper through said printer.

* * * * *